United States Patent [19]

Sharrow et al.

[11] 4,442,595

[45] Apr. 17, 1984

[54] KNIFE GUIDE

[76] Inventors: Robert F. Sharrow, 224 Longacre Ave.; Sidney L. Sherman, 5956 Jodie La., both of Erie, Pa. 16509

[21] Appl. No.: 365,170

[22] Filed: Apr. 5, 1982

[51] Int. Cl.[3] ..... B65B 7/00

[52] U.S. Cl. ..... 30/2; 30/294

[58] Field of Search ..... 30/2, 342, 289, 290, 30/294

[56] References Cited

U.S. PATENT DOCUMENTS 1,472,269 12/1923 Grimmer ..... 30/2

2,068,020 1/1937 Grounds ..... 30/2

2,120,960 6/1938 Arthur ..... 30/294

2,681,502 6/1954 Black ..... 30/2

*Primary Examiner*—E. R. Kazenske

*Assistant Examiner*—Douglas D. Watts

*Attorney, Agent, or Firm*—Charles L. Lovercheck; Wayne L. Lovercheck; Dale R. Lovercheck

[57] ABSTRACT

A utility knife guide made up of a body formed of sheet material bent to form a holder for the handle of the knife and a guide to control the path of cut of the blade parallel to a side edge of an object being cut.

3 Claims, 3 Drawing Figures

KNIFE GUIDE

REFERENCE TO PRIOR ART

Applicant is aware of the following prior art: U.S. Pat. Nos. 1,472,179, 1,069,189, 1,192,748, 3,889,367, 783,053, 3,184,843, 2,777,197, 3,178,812.

However, the above mentioned prior art does not disclose a knife guide having the simple, economical construction or the efficient operation of the present disclosure.

Utility knives have been on the market for many years. Utility knives are small, hand-held knives with a replaceable, short, pointed, cutting blade that is retractable into the handle portion of the knife. The blade usually has several projecting positions into which it locks automatically, allowing selection of the best blade projection for each job. With the blade fully retracted into the handle, the utility knife may be safely carried in pocket or purse.

Utility knives are useful for various cutting or slitting operations including a most common use of slitting open cardboard and corrugated paper boxes.

When used for slitting open cardboard or corrugated boxes, it is difficult to obtain a straight, neat cut, parallel with the box edge. This is because there is no easy way to guide the blade. It is the purpose of this invention to provide a simple inexpensive "guide", one that may be quickly attached to the utility knife for completing the slitting operation, but then is quickly removable to free the knife for other cutting usages.

GENERAL STATEMENT OF INVENTION

The knife and guide disclosed herein are suitable for opening cardboard cartons and the like by making an opening cut in the carton such as to efficiently form a large opening sufficient to remove the contents from the carton and to protect the contents of the carton against damage from the blade.

The guide may be made from a single piece of sheet material formed such that the handle of a utility knife is supported at both ends and the blade enters a support flange through a slot in one end and another integral flange forms a slide along a side of the carton.

OBJECTS OF THE INVENTION

It is an object of the invention to provide a guide for a utility knife that is simple in construction, economical to manufacture and simple and efficient to use.

It is another object of this invention to provide a simple, inexpensive "guide", one that may be quickly attached to a utility knife for completing the slitting operation but then is quickly removed to free the knife for other cutting usages.

An object of this invention is to provide a simple flat surfaces on the guide that may be imprinted or engraved with advertising, thereby resulting in appeal to paper companies, box companies and manufacturers for use as advertising specialty items.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF DRAWING

Figure 1:
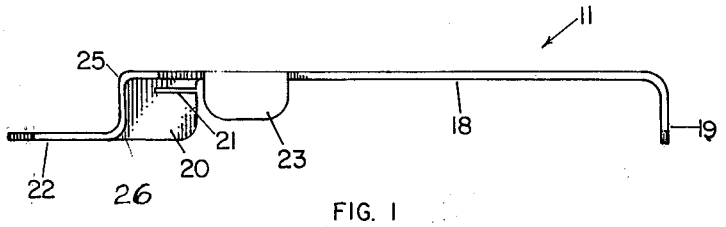
FIG. 1 is a top view of a knife guide according to the invention.
Figure 2:
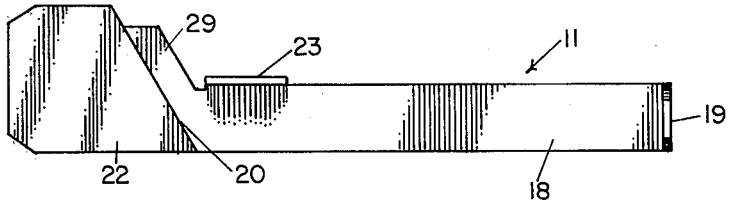
FIG. 2 is a side view of the knife guide shown in FIG. 1.
Figure 3:
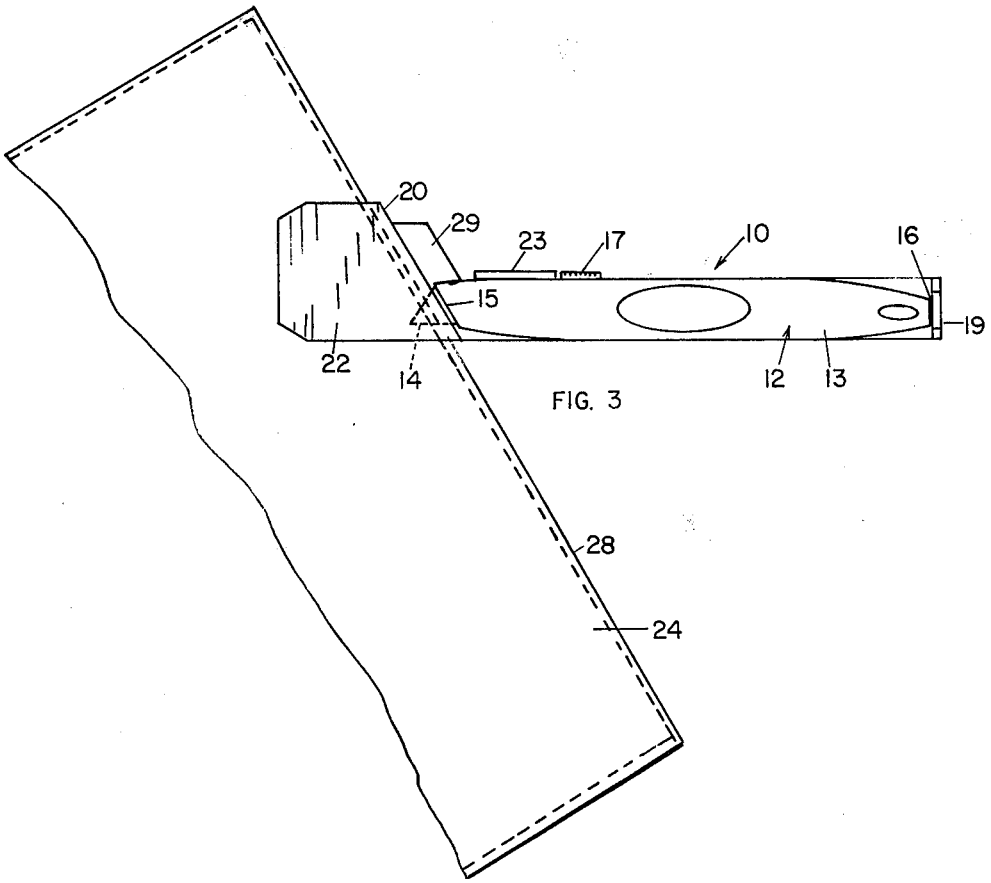
FIG. 3 is a side view of the knife guide similar to FIG. 2 showing the knife guide use in opening a container.

A combination utility knife guide and knife are shown in combination indicated generally at 10. The knife guide has a handle portion 18, a blade-support portion 20 and a guide portion 22. An end portion 19 formed by bending the material of the guide at 24 generally perpendicular to the handle part 18.

The blade-support part 20 is bent at 25 generally at right angles to the handle part 18 and in the direction generally parallel to the end 19. The guide part 22 is formed by bending the material at 26 generally parallel to the handle part 18 and generally perpendicular to the blade support part 20. The blade-support part 20 is bent in a plane perpendicular to the handle part 18 and the plane contained by the blade part 20 is disposed at approximately 30° to the plane contained by the end part 19. A knife 12 may be placed in the guide 11 with an end 16 of the knife abutting against the end part 19 and the inclined part 15 of the knife handle resting against the blade part 20 of the holder and the blade 14 of the knife extending through the slot 21 in the knife guide. The knife 12 shown has a handle 13 and a button 17 of a type familiar to those skilled in the art which is connected to the blade 14 to adjust its position outward from the handle.

The stop part 23 on the guide overlies the top of the knife 12 holding the handle end 15 against the blade-support part 20 of the guide thus when the knife is inserted in a cardboard carton to be opened such as the carton 24, with the guide part 22 resting against the top of the carton and the blade extending through the side 28. Inclined surface 15 resting on the blade-support part 20 which will urge the knife handle against the stop 23 and end portion 19. The operator's hand will hold the end of the handle 13 adjacent the end part 19 of the knife in position. It will be noted that the handle part is widened at 29 as indicated to act as a stiffener. The underside of the handle 18 and the top side of the guide 22 both have space suitable to receive a design or imprint with a logo to identify and serve as a personalized marketing item.

All embodiments shown are capable of imprint with logo and company identification to serve well in the personalized market.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a utility knife and knife guide and support comprising, a handle part, a guide part, a blade support, a stop, an end part, said handle part, guide part, blade support, stop part and end part being integral with each other and of generally uniform thickness, and having opposite sides lying in planes, a first plane disposed in one said handle part sides and a second plane disposed in one said guide part sides, said first plane and said second plane being disposed generally parallel to each other and spaced from each other, said handle part having a first end and a second end, said blade support having a first end and a second end, said first end of said blade support being integrally connected to said first end of said handle part, said second end of said blade support being integrally connected to a first end of said guide part, a third plane disposed in one of said blade support sides and generally perpendicular to said first plane and said second plane, a fourth plane disposed in one of said stop part sides and generally perpendicular to said first plane and said second plane, said stop part being integrally attached to a side edge of said handle part, said end part being integrally attached to said second end of said handle part and extending from said handle part in the same direction as said blade support part, a slot in said blade support part extending generally parallel to said guide part and spaced therefrom, said utility knife guide being adapted to support a utility knife having a handle having a first end and a second end with a blade attached to said first end and disposed in said slot and disposed generally parallel to said first plane and spaced therefrom, said first end of said utility knife handle resting on said blade support part and said second end of said knife handle resing on said end part and said stop engaging a side edge of said utility knife handle whereby said guide part may guide said blade in a path generally paralled to the side edge of a carton engaged by said guide part.

2. The utility knife recited in claim 1 wherein said third plane contained in said blade support part is disposed at an acute angle to said handle part.

3. The utility knife guide recited in claim 2 wherein said guide part is substantially wider than said handle support part and said handle support part has an end portion adjacent said first end substantially wider than the part of said handle part adjacent said second end of said handle support.

* * * * *